United States Patent [19]

Fildan

[11] Patent Number: 4,712,280

[45] Date of Patent: Dec. 15, 1987

[54] STRAP FASTENER

[76] Inventor: Gerhard Fildan, Dieselstrasse 20, D-7250 Leonberg, Fed. Rep. of Germany

[21] Appl. No.: 855,099

[22] Filed: Apr. 22, 1986

[51] Int. Cl.[4] ..... A41F 1/00

[52] U.S. Cl. ..... 24/625; 24/171; 24/196; 24/615; 24/633

[58] Field of Search ..... 24/589, 625, 605, 640, 24/642, 633, 653, 654, 657, 615, 616, 664, 665, 171, 172, 196, 323

[56] References Cited

U.S. PATENT DOCUMENTS

| | | | |
|---|---|---|---|
| 3,163,905 | 1/1965 | Gaylord | 24/196 |
| 3,181,189 | 5/1965 | Leyden | 24/625 X |
| 3,226,791 | 1/1966 | Carter | 24/196 X |
| 3,408,707 | 11/1968 | Hemphill | 24/196 X |
| 3,430,306 | 3/1969 | Tareau | 24/625 X |
| 4,035,877 | 7/1977 | Brownson et al. | 24/171 X |
| 4,136,422 | 1/1979 | Ivanov et al. | 24/171 X |
| 4,150,464 | 4/1979 | Tracy | 24/196 X |
| 4,398,324 | 8/1983 | Bakker et al. | 24/615 X |
| 4,569,106 | 2/1986 | Lovato | 24/615 |
| 4,577,377 | 3/1986 | Kasai | 24/625 |

FOREIGN PATENT DOCUMENTS

| | | | |
|---|---|---|---|
| 8501192 | 3/1985 | European Pat. Off. | 24/633 |
| 2169 | of 1878 | United Kingdom | 24/171 |
| 2150632 | 7/1985 | United Kingdom | 24/633 |

*Primary Examiner*—Kenneth J. Dorner
*Assistant Examiner*—Laurie K. Cranmer
*Attorney, Agent, or Firm*—Karl F. Ross; Herbert Dubno

[57] ABSTRACT

A separable connector for strap ends has a tapered tongue guided in a socket member between guide ribs so that passages are formed outwardly of these ribs for deflectable tongues which lodge in slits of the socket member. The plug member of the connector or, more generally, a buckle for a strap end, can have a movable bar about which the strap can be looped and which has wedge-shaped formations at its ends guided in wedge-shaped slots so that canting of the bar is prevented when the bar clamps the strap end against the movable bars.

2 Claims, 13 Drawing Figures

STRAP FASTENER

FIELD OF THE INVENTION

My present invention relates to strap fasteners and, more particularly, to terminations for belts, straps and the like, e.g. as buckles for interconnection of ends of a single strap or of two straps, as separable fasteners, and generally as connectors for one or two strap ends.

BACKGROUND OF THE INVENTION

It is known to provide flat strap materials, such as belts, webs and the like, hereinafter referred to as straps, with buckles or other connectors at an end of the strap for connection to another connector member which interfits with the first-mentioned connector, for receiving the other end of the strap, or in a similar or even different manner to allow connection of the first-mentioned strap end to another member or strap end.

Separable connectors, for example, for this purpose can include male and female members, the male member having a pair of deflectable elements which can lock in windows of the female member while a central tongue extends from the male member into the female member as a guide.

A disadvantage with such systems, described in German Pat Nos. 511,410 and 1,199,937, U.S. Pat. No. 4,150,464, and Swiss Pat. No. 554,151 is that considerable force is necessary to operate the connector or, where less force is required or the device is relatively simple, as in the aforementioned U.S. patent, it is necessary to carefully align the parts before they are fitted together.

In such connectors and buckles generally, it is also known to pass the strap through a slot in the buckle or connector, the slot being defined in part by a movable bar which is so oriented with respect to the way in which the strap is passed through the loop or around this bar, that tension on the strap draws the bar more tightly against the strap and thereby increases the clamping force and resistance to slip of the strap as tension increases.

The connectors and buckles of the invention can be utilized for a variety of purposes, including luggage, tie-downs for slipless adjustment of the affected length of the strap, in rucksacks and shoulder bags, for shoulder straps for a variety of other purposes and even for belts and straps for life preservers and even for fastening articles or loads in places.

One of the problems with such self-tightening clamping systems is that it is possible for the movable bar to tilt into such a position that it jams in its guides and is incapable after such a jamming of effectively clamping the strap.

The problem appears to arise from the fact that to allow free passage of the strap before the traction is applied and clamping is to ensue, it is necessary to provide a bar with some play in its guide. When the guide consists of a pair of guide slots receiving the rectangular or square end bar with play, therefore, it is possible for the bar to twist somewhat so that corners of the rectangular ends can brace or jam against opposite flanks of the guide groove and prevent effective clamping movement. The problem can of course be eliminated by the use of a round bar, but in this case the clamping action is less effective.

OBJECTS OF THE INVENTION

It is the principal object of the present invention to provide an improved separable connector for two strap ends which avoids the drawbacks of the separable connectors mentioned above and assures self-aligning of the two parts with a high degree of precision and minimum care on behalf of the user.

Another object of the invention is to simplify the manipulation of separable connectors of the latter type and especially eliminate the need for careful prealignment before the male member is inserted in the female member.

Yet another object of this invention is to provide an improved method of securing the connector parts to respective strap ends and, more specifically, the avoid the danger that canting of a clamping bar may prevent the bar from locking effectively against the strap.

It is a more general object of this aspect of my invention to provide an improved device for attaching a buckle or like connector member to a strap end.

SUMMARY OF THE INVENTION

These objects and others which will become apparent hereinafter are attained, in accordance with the invention with a separable connector for strap ends which comprises, as a female or socket member, a flat body having an insertion opening at one end and locking slits in oppositely disposed side walls, and a plug member having an end portion which is insertable into the aforementioned opening and a passage formed in the body of the socket member. According to the invention, guide ribs in the socket member cooperate with guide tongues of the plug member, the guide tongues include a central tongue and a pair of lateral guide tongues, the latter being formed along their outer sides with free ends having locking formations which engage in and lock into the aforementioned slits. Because the lateral tongues project from these slits, they can easily be depressed manually inwardly to permit the plug member to be withdrawn from the socket member.

According to the invention moreover, the central or guide tongue, of the flat plug member, has in plan view or in projection on a plane parallel to the plane of the body of the plug member, a generally V shape which is truncated at its free end and the lateral or locking tongues are parallel to a shank portion of the central tongue, the shanks of the lateral tongues being provided with the locking formations at the free ends of these shanks.

According to the invention moreover, the central guide tongue also tapers in thickness toward its free end from its junction with the shanks and the selection at which the shanks and the central tongue are formed unitarily on the body which can be provided with a clamping bar arrangement as described below for securing the body to a strap end.

The guide ribs in the passage of the female member have a spacing from one another which is a relatively large fraction of the width of the socket member, namely at least one half of the latter.

The connector as described or a buckle fastened to the end of the strap can be provided, as noted, with a pair of guide slots in opposite sides of a window accommodating the movable bar, with the strap at least in part passing between the movable bar and a stationary bar or edge of the window. According to the invention, end formations on the bar taper in the direction of clamping movement thereof and the slots in which these formations are guided are likewise tapered in this direction.

This ensures effective clamping action without canting in such manner as to preclude effective clamping.

Furthermore, the separable connector for two strap ends can comprise a socket member constituted as a flat body formed with an insertion opening at one side thereof subdivided into a central opening and a pair of lateral openings flanking the central opening, a central passage extending linearly into the body from the central opening, and respective lateral passages each extending into the body from a respective one of the lateral openings and terminating in respective locking slits provided at opposite edges of the body; and a plug member constituted with a flat body formed with a central guide tongue insertable through the central opening and guided into the central passage, and a pair of outer tongues flanking the central tongue and elastically deflectable inwardly toward the central tongue and insertable in the lateral openings and slidable in the lateral passages, the outer tongues having end formations engageable in the slits for impeding withdrawal of the plug member from the socket member, wherein:

the central guide tongue has a generally V shape in a projection in a plane parallel to the members truncated at a free end of the central guide tongue and is formed with a shank having parallel edges at an opposite end of the central guide tongue connected to the body of the plug member, the lateral tongues each have shanks which extend generally parallel to the shank of the central guide tongue and terminate in end portions engageable with the edges, the central tongue tapering in thickness from a region of the end portions to the free end, the central passage is separated from each of the lateral passages by a respective guide rib formed on the body of the socket member and engageable with the plug member, and the guide ribs are spaced apart by a distance substantially corresponding to the spacing of the parallel edges from one another and at least equal to half the width of the insertion opening of the socket member.

Each of the bodies can be formed with a bar at a side thereof remote from the other body and defining therein a slot accommodating a respective strap end.

The body of the plug member can be provided with a window bordered by the respective bar, and a movable bar in the window defining the slot in the body of the plug member with the bar bordering the window and forming a clamp element for a respective strap end received between the bars of the window.

The movable bar can be provided with wedge-shaped formations tapering toward the bar bordering the window, the body of the plug member being formed with lateral slots respectively receiving the wedge-shaped formations with clearance and tapered correspondingly with substantially the same angle of taper.

According to another aspect of the invention a buckle for a strap comprises a rectangular body formed with a window defined by a planar rectangular frame with a fixed bar at an edge of the body, and a pair of guide walls extending generally perpendicularly to the fixed bar, and a movable bar in the window parallel to the fixed bar and defining therewith a gap into which a strap can be passed and which can clamp the strap against the fixed bar. The movable bar is provided with wedge-shaped formations tapering toward the fixed bar bordering the window, the walls being formed with lateral slots respectively receiving the wedge-shaped formations with clearance and tapered correspondingly with substantially the same angle of taper and such that movement of the formations in the respective slots in a direction opposite the direction of taper thereof increases play between the formations and the slots whereas movement of the formations in the respective slots in an opposite direction wedges the formations without play in the slots.

The body can be formed with two such movable bars, each having respective wedge-shaped formations received in respective pairs if such lateral tapered slots, the slots and the formations of one of the movable bars being tapered in a direction opposite the direction of taper of the formations and slots of the other of the movable bars.

This body can be symmetrical with respect to a plane parallel to the bars and perpendicular to the frame.

Furthermore the movable bar can be formed with a central slit through which the strap can be drawn.

The wedge-shaped formations and the respective slots can have slightly different angles of taper so that the formations wedge into the slots in a self-locking manner.

Alternatively or in addition the walls can converge slightly in the direction of the fixed bar to clamp against the movable bar in a self-locking manner.

The walls are provided with flutes along external surfaces thereof which run transversely to the directions. Also the movable bar can be provided with flutes along external surfaces thereof which run transversely to the directions. Furthermore, the wedge-shaped formations are provided with flutes along external surfaces thereof which run transversely to the directions.

BRIEF DESCRIPTION OF THE DRAWING

The above and other objects, features and advantages of the present invention will become more readily apparent from the following description, reference being made to the accompanying drawing in which.

SPECIFIC DESCRIPTION

Figure 1:
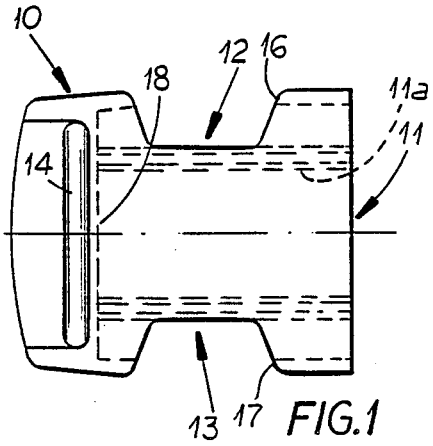
FIG. 1 shows a female member of a two-part connector in plan view in accordance with the invention.
Figure 2:
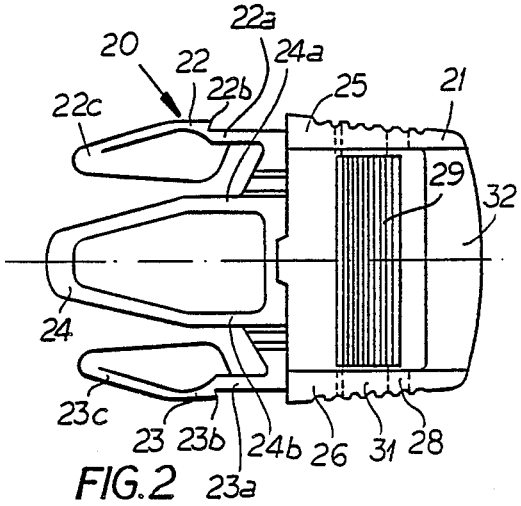
FIG. 2 is a plan view of the plug member adapted to be received in the socket member of FIG. 1.
Figure 1A:
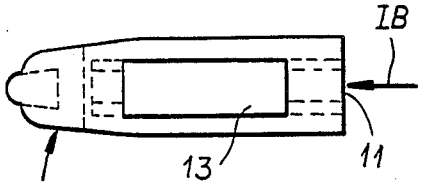
FIG. 1A is a side elevational view.
Figure 1B:
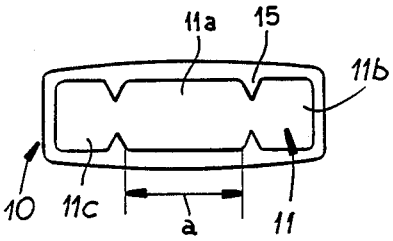
FIG. 1B is an end view in the direction of the arrow 1B in FIG. 1A.
Figure 3:
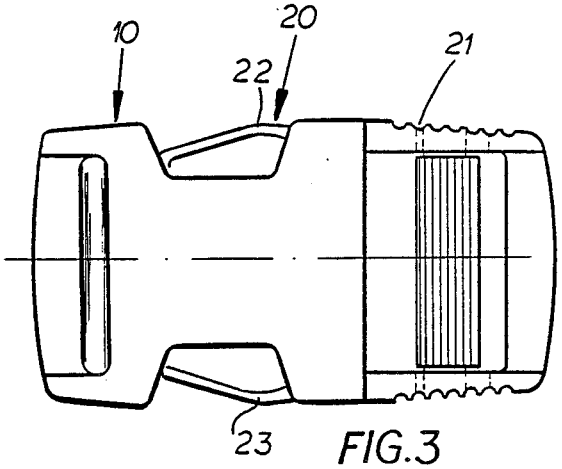
FIG. 3 is a plan view of the assembled connector.

The socket member 10 shown in FIGS. 1, 1A and 1B is in the configuration of a flat hollow body or sleeve which can receive a plug member 20 shown in FIGS. 2 and 2A to form the assembled connector illustrated in FIG. 3.

At its right-hand side, the flat body 11 has an insertion opening 11 and is formed with a passage 11*a* defined between pairs of guide ridges 15 formed on the socket member (FIG. 1B) and into which a central tongue 24 of the plug member can be inserted.

The opening 11 also defines a pair of lateral passages 11*b* and 11*c* to accommodate the lateral tongues 22 and 23 of the plug member, the passages 11*b* and 11*c* being interrupted by a pair of lateral locking slits 12 and 13 formed by corresponding cutouts of the socket member.

At the left-hand end of the body 10, a slot 14 is formed into which a loop of a strap can pass so that the connector is affixed to this end of the buckle.

It is possible to provide the slot 14 behind a movable bar and a stationary bar as described below with respect to FIG. 4 ff if desired. The guide ribs 15 cooperate with the plug member 20 as will be described in greater detail below.

Figure 2A:
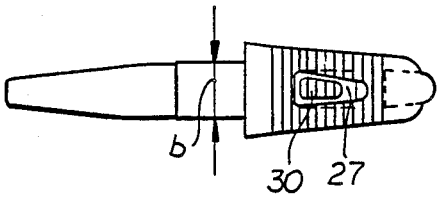
FIG. 2A is a side elevational view of the plug member of FIG. 2.

The plug member 20 illustrated in FIGS. 2 and 2A comprises, in addition to the tongues previously mentioned, an end portion 21 on the flattened body forming the plug member. The lateral tongues 22 and 23 are formed as spring arms identical with the end portion 21 and between which the guide tongue 24 is formed.

The spring arms 22 and 23 at their ends turn toward the portion 21 have necks or shanks 22*a* and 23*a* of somewhat reduced thickness (FIG. 2) and forming locking hooks 22*b* and 22*c* defined at least in part by inclined flanks 22*c*, 23*c*.

The guide tongue 24 has approximately the shape of a truncated V as seen in plan view or in projection on the plane of the paper, i.e. on a plane parallel to the plane of the connector.

Shanks 24*a* and 24*b* proximal to the end portion 21 are parallel to one another and by comparison to the spring arms 22, 23, the guide tongue 24 is relatively rigid, i.e. rigid in itself as well as in its connection to the end part 21.

The end part 21 is formed as a rectangular frame with guide sides 25 and 26 in which wedge-shaped guide slots 27 and 28 are formed.

In the window formed by the frame, a bar 29 is movable, this bar having end portions 30 and 31 which are received in the guide slots. The bar 29 cooperates with a fixed bar 32 in the end portion 21 of the body of the plug member when tension is applied to a strap passing around the bar 29 and thus lying on both sides thereof.

The spring arms 22 and 23 are so arranged and dimensioned that upon insertion of them into the socket member 10, the angled-away outer flanks 22*c*, 23*c* are bent elastically inwardly and, as they reach the slits 12 nd 13 spring outwardly to lock the plug member in the socket member (see FIG. 3). The hook formations 22*b* and 23*b* here engage behind the locking flanks 16 and 17 of the the socket member 10. The insertion movement is limited when the front end of the guide tongue 24 comes to bear on the inner surface 18 of the socket member 10.

During insertion of the plug portion of member 20 into the socket member 10, the guide tongue 24 cooperates with the guide ribs 15 to prevent lateral displacement of the guide tongue.

It has been found to be advantageous to form the clear spacing a between the guide ribs 15 to be substantially equal to the width of the guide tongue 24 at the shank ends 24*a*, 24*b*. The form of the guide tongue with its wedge shape in plan view and its taper in a cross section in a plane perpendicular to the plane of the connector toward the truncated free end of the tongue 24, greatly simplifies the insertion of the plug member in the socket member, enables unintentional misalignment to be corrected automatically and allows assembly even if the parts happen to be not exactly aligned. The device is thus self-correcting regardless of the plane in which a misalignment is found.

The height of the opening or passage accommodating the tongues of the plug member should be equal to the thickness b of the tongue member at the shank ends 24*a*, 24*b* plus a slight play.

The guide tongue 24, moreover, extends in width over a major part of the width of the socket member 10, preferably at least one half this width so that even assembly of the connector blind will ensure effective insertion of the tongues into the respective passages.

The bar 29, which serves to clamp a strap end against the fixed bar 32, is provided at its ends with guide formations 30 and 31 received in guide slots 27 and 28 in opposite walls or guide sides 25, 26 of the end portion 21 of the plug member 20.

These guide formations are wedge-shaped with substantially the same wedge angles and the convergence of the opposite flanks of the slots 27 and 28 is likewise at approximately the same angles.

Consequently, as each guide formation moves to the left in the respective slot, the play between the walls of the slot and the guide formation increases whereas upon movement of the wedge-shaped formations to the right, the play decreases to zero and locks the wedge formation by a wedging action. The wedging action can be enhanced by making the angle of the flanks of the slots slightly different from the wedge angle of the formations. Flutes are provided on the formations on the side walls and on the bar as has been shown described previously to facilitate gripping the formations and the sides of the connector and firm engagement of the bar 29 with the strap end. Canting is precluded of the wedge formations in the respective slots.

Referring now to FIGS. 4–6A, where I have shown buckles utilizing the same strap clamping mechanism as has been described in connection with FIGS. 1–3A, it can be seen that the buckle body 102 can have two guide sides 104, 106 interconnected by three fixed bars 108, 110 and 112 all molded unitarily in a single piece to permit a window 102*a* and a slot 102*b* through which the strap ends can pass in any conventional manner.

The two bars 108 and 110 are located close to one another at one end of the body so that one strap end can be threaded through the slot 102*b*, passed around the bar 110 and stitched to itself or fastened in some other manner in a loop around the bar 10. The loop can also be provided around bar 108, if desired.

The bar 112 should be a wider bar and can be formed with a grip lug 114. Juxtaposed with this bar 112 is a movable bar 116 which is fluted along its surface and is provided at its ends with guide formations 118, 120 which are respectively guided in guide slots 122 and 125 in the opposite sides 104, 106 of the frame around the window 102*a*.

Figure 4:
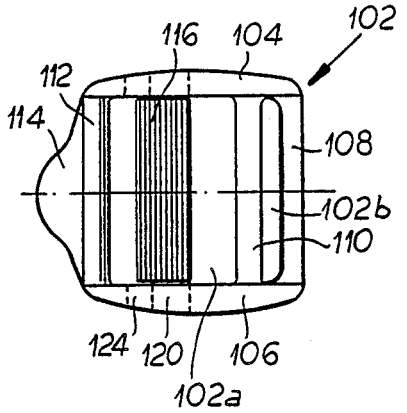
FIG. 4 is a plan view of a buckle utilizing the movable bar of the invention.
Figure 4A:
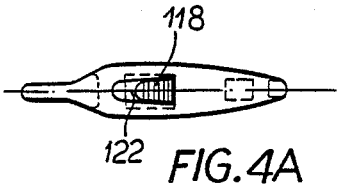
FIG. 4A is a side elevational view of this buckle.
Figure 3A:
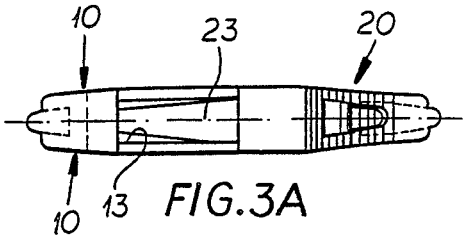
FIG. 3A is a side elevational view of the assembled connector.

The guide formations 118 and 120 and the slots 122, 124 are wedge shaped and converge to the left in the construction in FIGS. 4 and 4*a*.

In the unstressed position of the bar 116, wherein it has moved or has been moved toward the center of the buckle, a relatively large play is provided between the slots of the slots 122, 124 and the formations 118, 120, a play which increases as the formations shift to the right in FIG. 4 or FIG. 4A.

A strap end is looped around the bar 116 so that a portion of the strap end is received between this bar and the bar 112 which can also be fluted where it is juxtaposed with the bar 116 and engageable with the portion of the strap end received between it and the bar 116.

When tension is applied to the strap, therefore, the bar 116 is drawn to the left to clamp the strap against the bar 112. The wedge angles between the formations 118, 120 and the slots 122, 124 is approximately the same so that in the strap-clamping position, the convergent ends of the formations lodge without play in the convergent ends of the slots.

The outer ends of the formations 118, 120 are here also fluted (see FIG. 4A) to allow the fingers of the hand to grip the bar and draw it back in the slots to facilitate release of the buckle.

Figure 5:
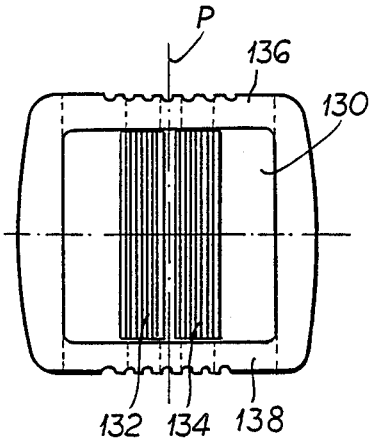
FIG. 5 is a plan view of a buckle having two movable bars in accordance with the invention.
Figure 5A:
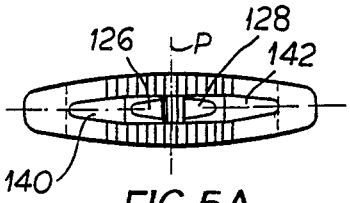
FIG. 5A is a side elevational view of this buckle.

In FIGS. 5 and 5A, the window 130 defined by the frame and flanked by the guide sides 136, 138 receives two movable bars 132, 134 which are fluted and have respective wedge-shaped guide formations 126, 128 received in respective slots 140, 142. In this case, the formations of the two bars are wedge shaped but converge in opposite directions as do the respective slots. Each of the bars functions to clamp a respective strap end looped therearound as has been previously described and the only difference here, of course, is that the movable bars and their guide slots are symmetrical with respect to a plane P perpendicular to the plane of the buckle (see FIGS. 5 and 5A). The strap ends can be released and locked individually by engagement of the fluted formations of the bar.

Figure 6:
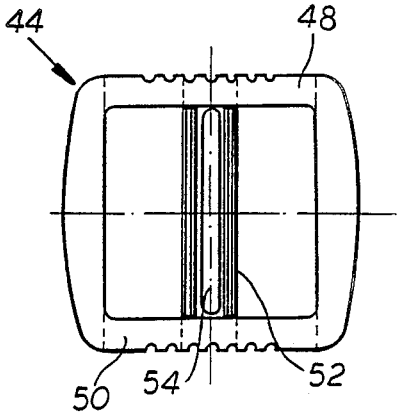
FIG. 6 is a plan view of yet another buckle embodying the invention.
Figure 6A:
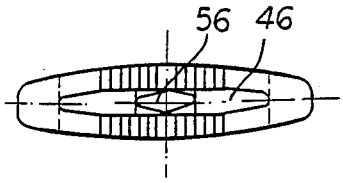
FIG. 6A is a side view of this buckle.

In the embodiment of FIGS. 6 and 6A, the buckle is generally similar to that of FIGS. 5 and 5A except that a single movable bar is provided with its guide formations wedge-shaped in both directions and being received in a single slot 46 which likewise tapers at its opposite ends. Here the bar 56 of the buckle 48 is provided with a slot 54 through which a strap end can be looped. Thus movement of the bar in either direction can serve to clamp the bar against a strap end.

In all of the embodiments illustrated, the wedge angle of the guide formations of the movable bar and the slots receiving these formations are approximately the same.

Of course the wedge angles of the guide slots can be slightly different from those of the formations to provide a self-clamping action of the wedge formations in the guide slots. It is also possible to accomplish this result by making the sides of the frame not precisely parallel but rather somewhat convergent toward the stationary bars so that a wedging action is effected by clamping against lateral faces of the movable bars. This has been shown to be the case in FIG. 6.

I claim:

1. A separable connector for two strap ends, comprising:

a socket member constituted as a flat body formed with an insertion opening at one side thereof subdivided into a central opening and a pair of lateral openings flanking said central opening, a central passage extending linearly into said body from said central opening, and respective lateral passages each extending into said body from a respective one of said lateral openings and terminating in respective locking slits provided at opposite edges of said body; and a plug member constituted with a flat body formed with a central guide tongue insertable through said central opening and guided into said central passage, and a pair of outer tongues flanking said central tongue and elastically deflectable inwardly toward said central tongue and insertable in said lateral openings and slidable in said lateral passages, said outer tongues having end formations engageable in said slits for impeding withdrawal of said plug member from said socket member, and wherein:

said central guide tongue has a generally V shape in a projection in a plane parallel to said members truncated at a free end of said central guide tongue and is formed with a shank having parallel edges at an opposite end of said central guide tongue connected to said body of said plug member, said parallel edges defining therebetween a maximum width of said tongue, said lateral tongues each have shanks which extend generally parallel to said shank of said central guide tongue and terminate in end portions engageable with said parallel edges, said central tongue tapering in thickness from a region of said end portions to said free end, said central passage is separated from each of said lateral passages by respective pairs of guide ribs formed on said body of said socket member and engageable with said plug member the guide ribs of each pair projecting toward one another from opposite ends of the socket member, said pairs of guide ribs are spaced apart by a distance substantially corresponding to the spacing of said parallel edges from one another and at least equal to half of a width of the insertion opening of said socket member, said body of said socket member is formed with a bar at a side thereof remote from the other body when the bodies are engaged with one another and defining therein a slot accommodating a respective strap end, and said body of said plug member is provided with a window bordered by a movable bar and a fixed bar and forming a clamp element for another strap end received between the bars of said window.

2. The separable connector defined in claim 1 wherein said movable bar is provided with wedge-shaped formations tapering toward the bar bordering said window, said body of said plug member being formed with lateral slots respectively receiving said wedge-shaped formations with clearance and tapered with substantially the same angle of taper as said formations.

* * * * *

UNITED STATES PATENT AND TRADEMARK OFFICE

CERTIFICATE OF CORRECTION

PATENT NO. : 4,712,280

DATED : 15 December 1987

INVENTOR(S) : Gerhard FILDAN

It is certified that error appears in the above-identified patent and that said Letters Patent is hereby corrected as shown below:

Title page:

After filing date of serial number [22] insert

-- [30] Foreign Priority Data

April 26, 1985 - Federal Republic of Germany 85 12 411

April 30, 1985 - Federal Republic of Germany 85 12 710

--

Signed and Sealed this

Nineteenth Day of April, 1988

*Attest:*

DONALD J. QUIGG

*Attesting Officer*

*Commissioner of Patents and Trademarks*